United States Patent [19]

Battaglia

[11] 4,166,472

[45] Sep. 4, 1979

[54] HAIR CURLER AND STAND

[76] Inventor: Anthony Battaglia, 455 NW. 202nd Ter., Miami, Fla. 33169

[21] Appl. No.: 833,824

[22] Filed: Sep. 16, 1977

[51] Int. Cl.[2] ..... A45D 1/00

[52] U.S. Cl. ..... 132/9

[58] Field of Search ..... 132/34 R, 9, 33, 40, 132/42, 37

[56] References Cited

U.S. PATENT DOCUMENTS

| | | | |
|---|---|---|---|
| 152,844 | 2/1874 | Wajdik | 132/33 R |
| 517,350 | 3/1894 | Mathews | 132/34 R |
| 2,415,483 | 2/1947 | Greenstein | 132/33 R |
| 3,083,715 | 4/1963 | Trabish | 132/33 R |
| 3,413,984 | 12/1968 | Tracy et al. | 132/34 R |
| 3,705,974 | 12/1972 | Nilsson | 132/33 R |

*Primary Examiner*—G. E. McNeill

*Attorney, Agent, or Firm*—Salvatore G. Militana

[57] ABSTRACT

An improved hair curler and stand wherein the hair curler consists of a handle and a rotatable hair curling device removably mounted on the handle, the handle containing a motor and batteries for rotating the curling device and the stand having means for receiving the hair curling device and handle with heating means for heating the hair curling device when stored on the stand.

2 Claims, 7 Drawing Figures

HAIR CURLER AND STAND

BACKGROUND OF THE INVENTION

1. Field of the Invention

This invention relates to an improved hair curler and is also directed to a combined hair curler and stand.

2. Description of the Prior Art

The conventional curling irons consist of an alligator-type clip for grasping the hair which is rotated by the operator to form a curl and are provided with a heating element to heat the curling iron at the same time as the operator is forming curls. In order to form curls, the operator has to rotate the curling iron after grasping strands of hair with the device. Also, there is a danger that the curling iron can become too hot, and thereby scorch the hair or not be hot enough to properly set the curls being formed. He must be most alert and very skillful in order not to burn one's hair and yet produce proper hair curls. The present invention contemplates avoiding the above objections to the conventional hair curlers by providing an improved hair curling device and a stand therefor.

SUMMARY OF THE INVENTION

Therefore, a principle object of the present invention is to provide an improved hair curler that consists of curling prongs removably and rotatably mounted on a handle containing a motor for automatically rotating the curling prongs.

Another object of the present invention is to provide an improved hair curler and a stand with heating means for receiving the hair curler thereon and heating same when not being used to curl hair.

A further object of the present invention is to provide an improved hair curler consisting of curling prongs removably mounted on a handle and a stand with heating means for receiving the separated curlings prongs and handle and heating the curling prongs preparatory to curling hair.

A still further object of the present invention is to provide an improved hair curler and a stand that is compact in construction and most effective to heat the curler when received by the stand preparatory to being used to curl hair.

With these and other objects in view, the invention will be best understood from a consideration of the following detailed description taken in connection with the accompanying drawings forming a part of this specification, with the understanding, however, that the invention is not confined to any strict conformity with the showing of the drawings but may be changed or modified so long as such changes or modifications mark no material departure from the salient features of the invention as expressed in the appended claims.

DESCRIPTION OF THE PREFERRED EMBODIMENT

Figure 6:
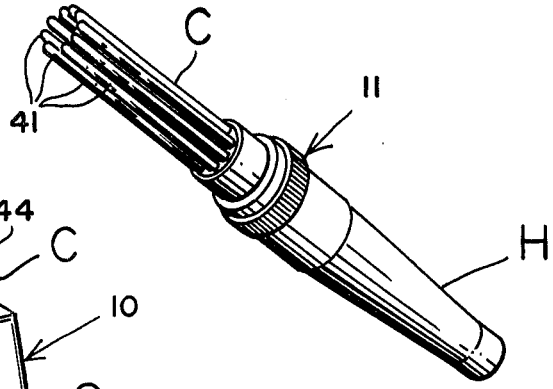
FIGS. 6 and 7 are perspective views of the curling iron shown assembled and disassembled respectively.

Referring to the drawings wherein like numerals re used to designate similar parts throughout the several views, the numeral 10 refers to my combined automatic hair curler and stand consisting of a stand —S— and a curling iron 11, the latter consisting of a handle —H— and a curling iron —C—, of which there are two individually housed on the stand —S— as is explained in detail hereinafter.

The stand —S— consists of a pair of upright side wall portions 12 and 13 that abut against a plate member 20 and fastened together by screws or rivets 14, the side wall 12 being flat while the center portion of the side wall 13 extends outwardly of the flange portions 15 to form a chamber 16. Within the chamber 16 is a heating element 17. The walls 12 and 13 are supported by leg portions 18 that extend away from each other terminating in foot portions 19 that maintain the stand —S— in an upright position. Secured to each of the side edges of the plate member 20 is an upstanding cylinder 21 having a conical opening 22 extending axially thereof from the top edge portion of the cylinder 21. It is to be noted that the various parts of the stand —S— are constructed of metal for the purpose of transmitting the heat received from the heating element 17 to the cylinders 21 and to the leg portions 18 the foot portions 19 for the dissipation of excess heat.

Figure 1:
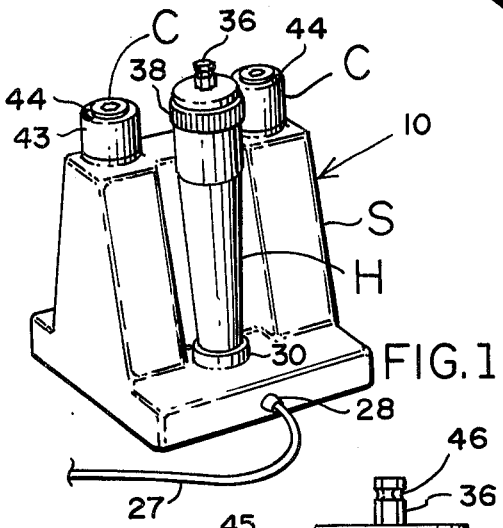
FIG. 1 is a perspective view of my combined hair curler and stand.
Figure 4:
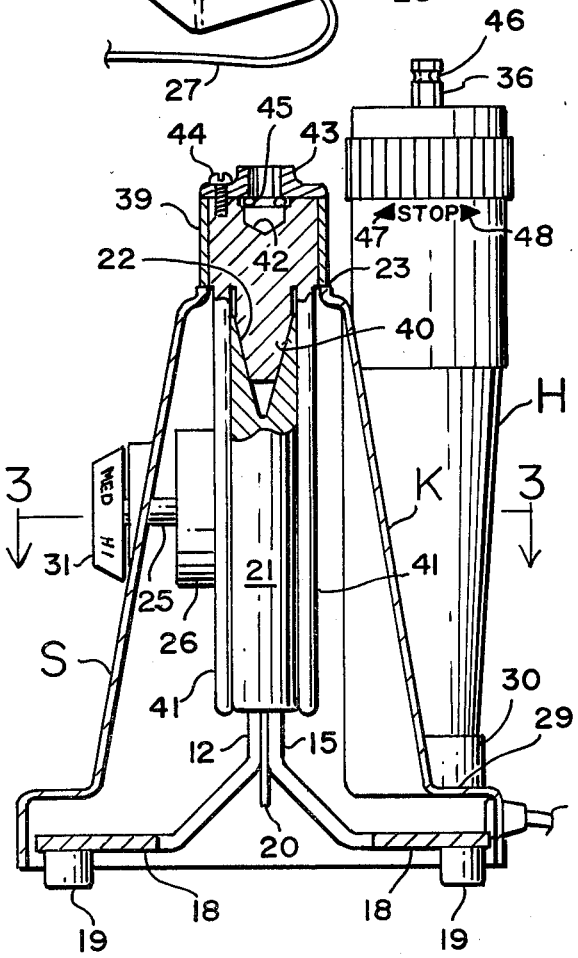
FIGS. 4 and 5 are cross sectional views taken along the lines 4—4 and 5—5 respectively of FIG. 3.
Figure 5:
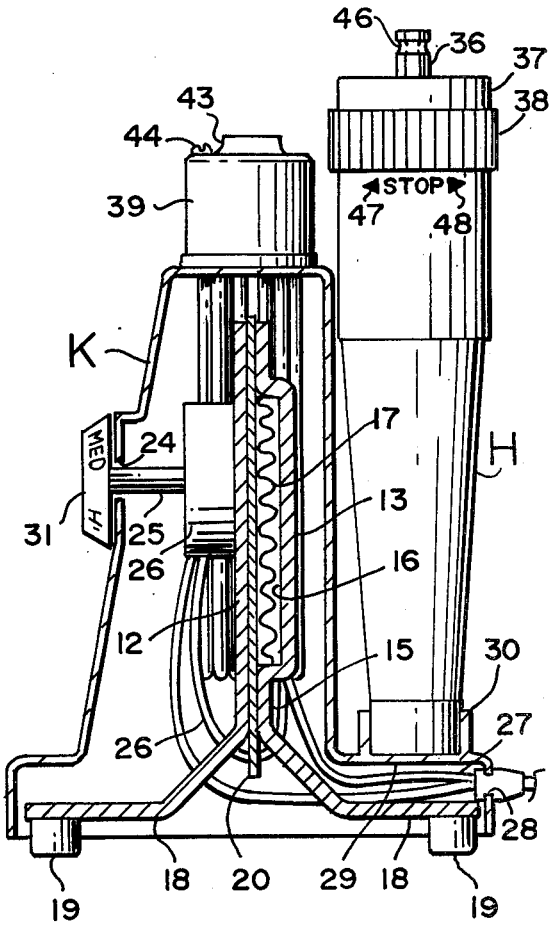
Figure 7:
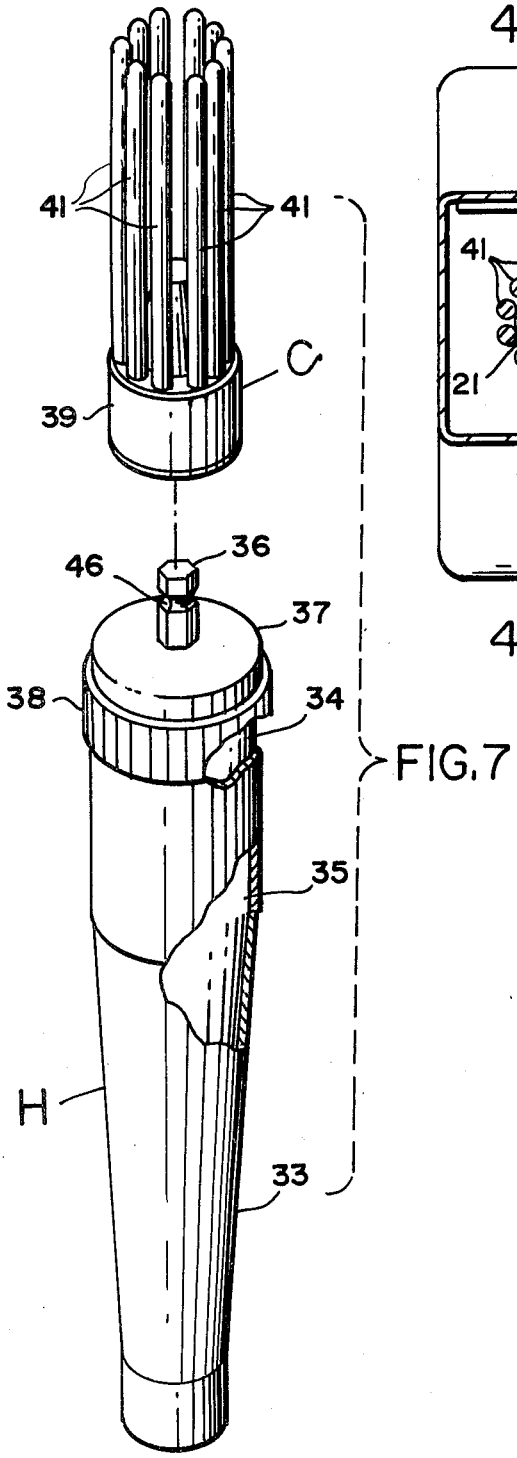
Figure 3:
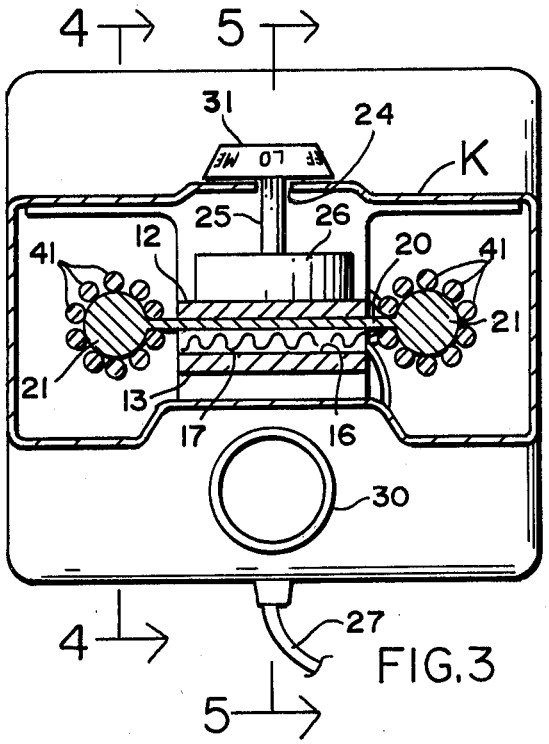
FIG. 3 is a cross sectional view taken along the line 3—3 of FIG. 4.
Figure 2:
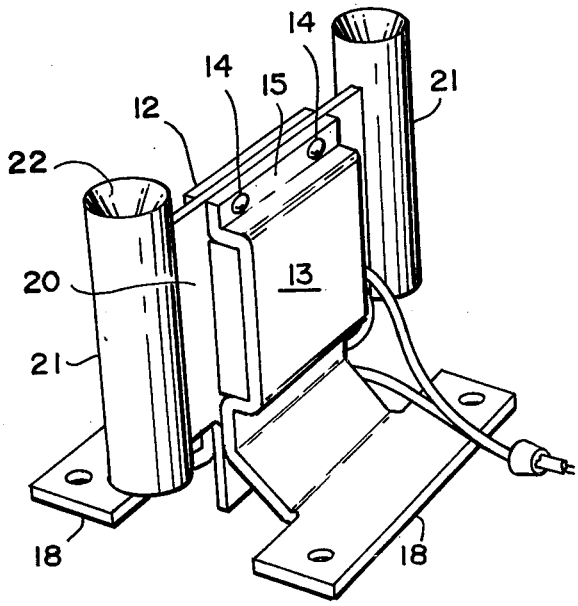
FIG. 2 is a similar view with the housing and curling irons removed therefrom.

The stand —S— is also provided with a housing —K— which completely enshrouds the device 10 both for esthetic purposes as well as providing protection to the user against the heat generated by the element 17 and has a pair of circular openings 23 concentric with the openings 22 of the cylinders 21. There is a further opening 24 in the housing —K— in the side wall of the housing —K— for the shaft 25 of a conventional switch 26 mounted on the side wall portion 12. The switch 26 is connected in a conventional manner to the heating element 17 on one side by wires 126 and to wires 27 on the other side that extend through an opening 28 to a source of electricity (not shown). The switch 26 is actuated at a knob 31 mounted on the switch shaft 25. A support for the single handle —H— of the curlers 11 is formed on a horizontal portion 29 by a circular upright wall portion 30 welded or otherwise secured thereto. The support 30 maintains the curler handle —H— in an upright position when not in use and seated therein as best shown by FIGS. 1 and 5.

Two hair curlers 11 are provided with each stand —S— so that when not in use, the curlers 11 are positioned in the openings 23 of the housing —K— and when an operator is using one of the hair curlers 11, the other hair curler 11 is being heated by the heating element 17.

The handle —H of the curling device 11 consists of a tubular member 33 at one end of which is contained a reversible motor 34 energized by a battery 35 positioned in the remander of the tubular member 33 that forms a handle for the hair curler 11. The motor 34 effects the rotation of a shaft 36 that extends through the cap 37 mounted over the end of the tubular member 33. A conventional switch (not shown) mounted within the cap 37 permits the actuation of the shaft 36 upon relative rotational movement of the cap 37 on the tubular member 33 in either direction as indicated by the arrows 47 and 48 to cause the prongs 41 to rotate in that desired direction. Release of the cap 37 by the operator causes the switch to return to its off position.

The cap 37 is knurled as at 38 for the purpose of assisting the operator to rotate the cap 37. When the knurled portion 38 is released by the operator, the cap 37 will return to its original position to deactivate the motor 34.

Removably mounted on the handle —H— of the hair curler 11 is the curling iron —C— consisting of a cylindrical base member 39 having a conical projecting member 40 extending axially therefrom which is received by the opening 22 of the heating cylinders 21 when placed thereon. Extending about the member 40 is a circle of prongs 41 that engage the heating cylinder 21, and thereby become heated for curling hair. The other side of the base member 39 is provided with an opening 42 for receiving the shaft 36 when the curling iron —C— is mounted on the handle —H—. A cap 43 is secured to the base member 39 as by a screw bolt 44 for retaining a ball bearing detent member 45 which engages a peripheral groove 46 on the shaft 36 of the handle —H— for retaining the curling iron —C— on the hanle —H— when being used to curl hair.

When my hair curling device 10 is being readied for used, the operator houses the curling iron —C— and handle —H— in the stand —S— as shown by FIG. 1, connects the wire 27 to a source of electricity and turns on the switch 31. The heating element 17 will become energized and heated with the heat being transmitted by way of the plate 20, heating tubes 21 and the prongs 41; the excess heat being dissapated via the leg portions 18 of the plate structure 12, 13. When the prongs 41 have been sufficiently heated, the operator removes the handle —H— and one of the curling irons —C— from the stand —S—, allowing the other to remain thereon, and mounting the curling iron —C— on the handle —H—. He then activates the motor 34 of the handle —H— by rotating the cap 37 causing the shaft 36 and the prongs 41 to rotate. The operator then grasps strands of hair and inserts the ends thereof between the prongs 41 which coils the hair into curls. The heat of the prongs 41 sets the curl. When the prongs 41 of the curling iron —C— that he is using is no longer hot enough to set curls, he removes the curling iron —C— from the handle —H— replacing it with the curling iron —C— that was being heated in the interim at the stand —S—. The previously used curling iron —C— is now returned to the stand —S— to be reheated.

What I claim as new and desire to secure by Letters Patent is:

1. A combined curling iron and stand comprising a tubular member forming a handle for said curling iron, a rotatable shaft extending outwardly of said tubular member, hair curling means having a base member mounted on said shaft and a plurality of substantially parallel prongs disposed symmetrically about in a circle mounted on said base member, means removably mounting said base member on said shaft and power means mounted in said tubular member for rotating said shaft and said hair curling means, said stand having a plurality of substantially cylindrical members for receiving said hair curling means, a heating element mounted between said cylindrical members, and a plate member for transferring heat from said heating element to said cylinders, said plate member having side walls and edge portions and engaging said cylindrical members at said side edge portions, and a wall member engaging said plate member on each side of said plate member and forming a chamber for said heating element.

2. The structure as recited by claim 1 wherein said wall members having leg portions for supporting said stand and housing means mounted over said wall members, said housing means having an opening for each of said cylindrical members and further means for receiving said handle of said curling iron.

* * * * *